US006052898A

United States Patent [19]

Corrigan

[11] Patent Number: 6,052,898

[45] Date of Patent: Apr. 25, 2000

[54] METHOD OF WINDING FLUID HEATER COILS

[75] Inventor: Bernard C. Corrigan, Des Plaines, Ill.

[73] Assignee: Westinghouse Air Brake Company, Wilmerding, Pa.

[21] Appl. No.: 09/102,170

[22] Filed: Jun. 22, 1998

Related U.S. Application Data

[62] Division of application No. 08/865,119, May 29, 1997, Pat. No. 5,845,609.

[51] Int. Cl.[7] ..... B23P 15/26

[52] U.S. Cl. ..... 29/890.037; 29/890.03

[58] Field of Search ..... 29/890.037, 890.03; 165/162, 163; 122/209.1, 213, 214

[56] References Cited

U.S. PATENT DOCUMENTS

| | | | |
|---|---|---|---|
| 1,457,773 | 6/1923 | Frumveller | 29/890.037 |
| 3,353,250 | 11/1967 | Kikuchi et al. | 29/890.037 |
| 3,639,963 | 2/1972 | Maher | 165/162 |
| 3,809,061 | 5/1974 | Gerstmann | 126/350 R |
| 4,451,960 | 6/1984 | Molitor | 29/890.037 |
| 4,633,942 | 1/1987 | Mcmanus et al. | 29/890.037 |
| 4,785,878 | 11/1988 | Honkajarvi et al. | 165/163 |

*Primary Examiner*—I. Cuda
*Attorney, Agent, or Firm*—James Ray & Associates

[57] ABSTRACT

A method of winding a fluid carrying coil for compact fluid heater utilizing dual lengths of metallic tubing wound in a bifilar manner to establish fluid flow internal of each tubing length such that when terminated from the coil outer periphery flow in the coil portion of each tubing length is in opposition. The bifilar design provides coil termination at the coil outer periphery.

12 Claims, 7 Drawing Sheets

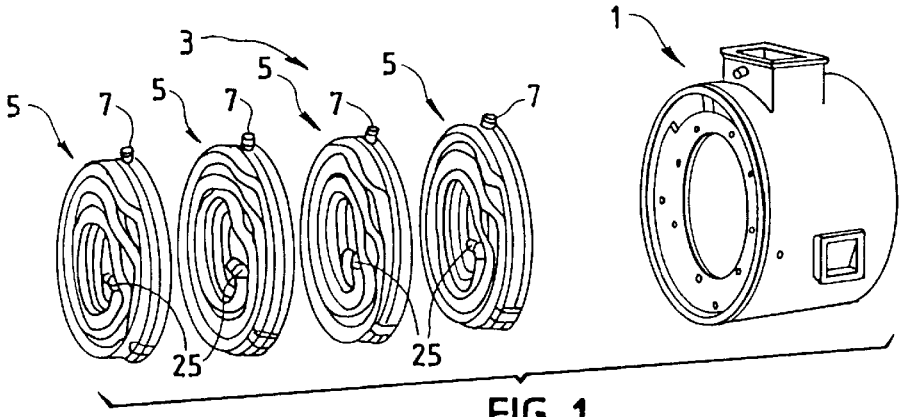
FIG. 1
PRIOR ART
FIG. 2
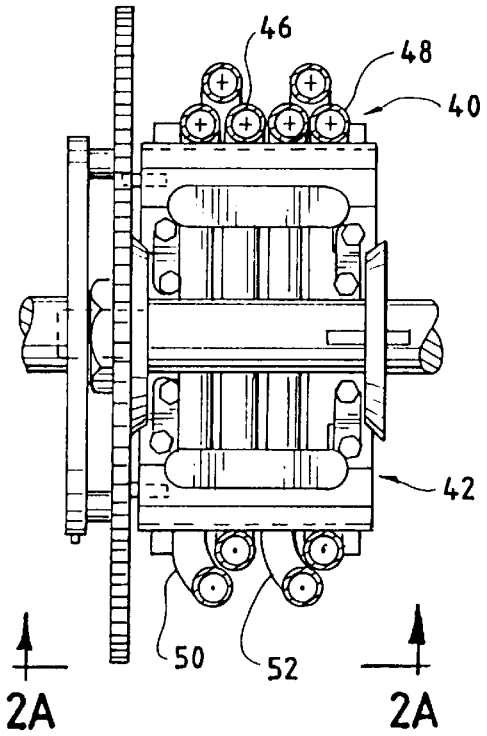
FIG. 2A
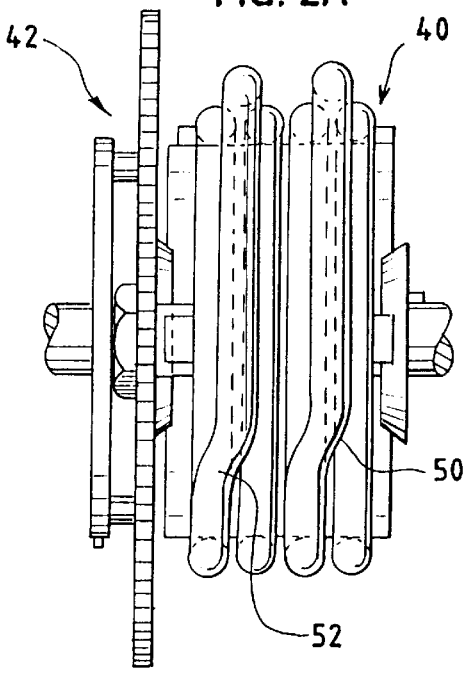

METHOD OF WINDING FLUID HEATER COILS

CROSS REFERENCE TO RELATED APPLICATIONS

This application is a division of patent application: IMPROVEMENTS IN FLUID HEATER COILS, which has Ser. No. 08/865,119, now U.S., Pat. No. 5,845,609.

BACKGROUND OF THE INVENTION

This invention relates generally to helically wound multi-layer coils for use in compact fluid heaters, particularly of the type disclosed in U.S. Pat. No 3,282,257, specification and claims of which are incorporated herein by reference thereto. Also incorporated by reference herein is U.S. Pat. No. 2,771,934 pertaining to coil winding techniques.

Generally speaking, coils of the type disclosed herein are utilized in high efficiency compact fluid heaters wherein coils are arranged in layers intermediate a combustion system and exhaust stack. The structure of this type of unit utilizes the combustion system to generate high temperature products of combustion from burning fuels flowing axially through the centers of stacked coils and then radially through successive layers of each coil from the internal diameter through an external diameter of each coil in a given stack. In this manner, heat is extracted from the burner flue gases by convective heat transfer to each turn and layer of the coil bank as the flow of combustion products progresses from the internal diameter through the external diameter, whereupon it is exhausted to the heater stack or exhaust means.

Presently used coils are wound on a mandril as shown on U.S. Pat. No. 2,771,734 (reference FIG. 1) from continuous lengths of metal tubing appropriately chosen for the operating temperatures and pressures involved. Thus, as wound, the initial end of a single length of coil is embedded in the first layer of a given coil as shown in U.S. Pat. No. 3,282,357 (reference FIG. 3). Coils of this type work properly. However, a difficulty arises in that internal connections to the coil must be made with the connection located in the path of combustion products. This type of connection extends into the combustion products flow of the associated burner utilized in the heater (reference FIG. 1 of U.S. Pat. No. 3,282,357).

With this structure, replacing a single coil of a manifolded bank becomes difficult and expensive, since it is necessary to enter the boiler from one end and physically detach the internal connection. Subsequently, it is necessary to re-enter the boiler to re-connect an internal end on a replace coil. Associated difficulties arise in that the coil positioning must be precise in order to match the manifold opening in place.

The invention disclosed herein overcomes the above mentioned difficulties through the use of a bifilar design incorporating two lengths of tubing per coil. Individual lengths of suitable tubing are simultaneously wound into rows and layers as in the above described standard coil. As wound, however, the initial ends of each tubing length, embedded in the coil first layer are joined so as to be fluid communicating. Subsequent layers then precede with simultaneous winding of the remaining lengths of the two individual tubing lengths until a final or outer layer of the coil is formed, having the terminal ends of the initial two tubing lengths embedded in the outer layer.

With the type of construction disclosed herein, fluid flowing into one of the outer layer tubing ends traverses the first tubing length now wound into rows and layers of the coil, passing through the joined initial ends of both first and second tubing lengths, returning to the outer layer through the second tubing length now wound into rows and layers of the coil, exiting in the terminal end of the second tubing now embedded in the outer layer. This coil construction overcomes the above mentioned replacement difficulties. Also outer layer coil termination provides a convenient location for manifolding fluid flow into and out of the banks of bifilar wound coils since the manifold devices can be located entirely at the heater surface.

It is, therefore, an object of the invention to provide a multi-layer multi-turn coil for a compact fluid heater wherein fluid flowing into and out of the coils can be terminated at the outer coil surface.

It is an additional object of the invention to provide a coil structure for a compact fluid heater wherein the inner coil tubing terminations do not project into the combustion gas flow.

It is yet an additional object of the invention to provide a coil structure for a compact fluid heater wherein coils can be serviced without severing termination in the combustion gas zones.

It is a further object of the invention to provide a coil for a compact fluid heater wherein fluid flowing in portions of the coil tubing are in both counterflow and parallel flow relationship with regard to heat exchange from products of combustion.

BRIEF DESCRIPTION OF THE DRAWINGS

Further objects and advantages of the invention will become apparent upon reading the following detailed description and upon reference to the drawings, in which:

FIG. 1 is a partial semi-pictorial perspective of coils positioned and manufactured according to existing practices today;

FIG. 2 is a partially sectioned drawing of a first layer of the coil of the invention in winding process mounted on the drum of a coil winding machine, particularly showing offset bending and crossovers from first and second tubing lengths in a first layer to a second layer wound from the first and second tubing lengths.

FIG. 2A is a partial semi-schematic drawing of the coil of FIG. 2, particularly showing the crossovers from a first tubing layer wound with first and second tubing lengths to a second tubing layer wound with said first and second tubing lengths when viewed from a position shown by an arrow indicated as 2A in FIG. 2.

BRIEF DESCRIPTION OF THE INVENTION

In particular reference to FIG. 1, there is shown in exploded view a coil assembly utilized in prior art units of the type disclosed and claimed in U.S. Pat. No. 3,282,357.

As shown, there is a coil housing assembly 1 and individual coils 5 mounted for series installation within coil housing assembly 1. As shown, each individual coil assembly 5 is essentially helically wound by a predetermined number of turns and layers of turns from a single length of tubing. As wound, each individual assembly 5 has a coil or tubing inlet at 25 and an exit at 7.

The location of inlet terminals 25 requires that connections to such terminal be constructed so as to occupy a channel of combustion gas flow entering the first or internal layer of coil tubing and exiting the external layer of tubing. This construction requires that the internal connections to each coil occupy and project into the flow channel of high temperature combustion products. These connections are, therefore, subject to a substantial amount of deterioration and further greatly complicate coil replacement since each internal coil connection must be severed by entering the relatively small combustion gas flow channel and operating either mechanical or gaseous metal cutting equipment in the confines of the aforementioned flow channel.

The invention disclosed herein avoids these internal connections by locating both coil inlets and outlets at the outer layer or periphery of each coil bank (reference FIG. 3). This construction greatly simplifies coil replacement and increases coil life since fabricated connections no longer occupy the combustion products flow channel.

DETAILED DESCRIPTION OF THE INVENTION

Figure 7:
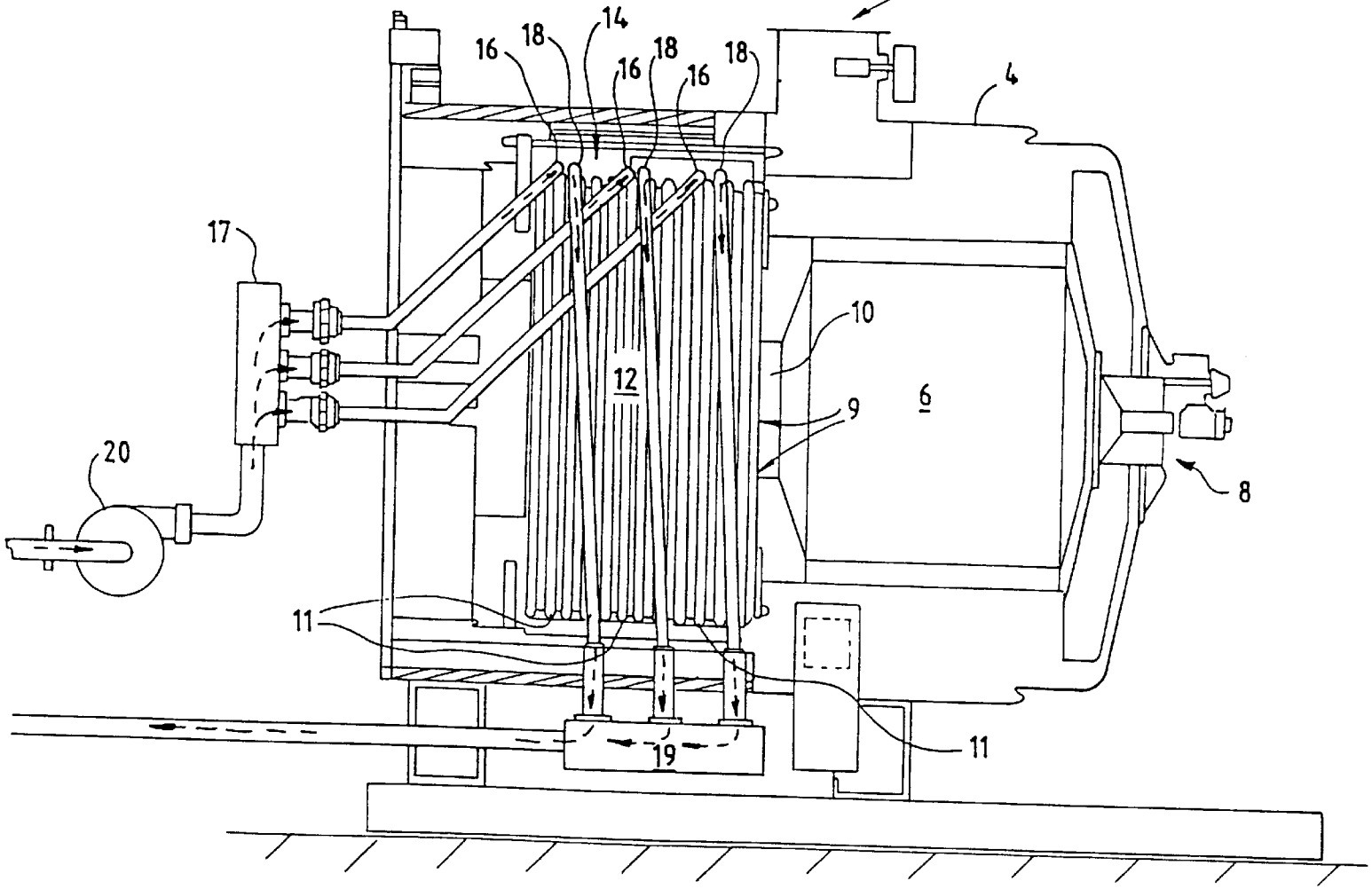
FIG. 7 is a schematic drawing of the coil of the invention shown in a typical fluid heater using a bank of three coils. Also shown are coil manifolds and a fluid circuit.

With respect to FIG. 7, there is shown a partial pictorial schematic of the coil of the invention arranged in a coil bank or section 12 having three individual coils 11 connected in parallel flow by manifolds 17 and 19. As shown, a three coil bank assembly 14 is mounted in the heater housing assembly 2. Also in assembly housing 4 is a combustor 6 generating products of combustion by burner 8 and exiting combustor 6 through outlet or choke 10, as shown by flow direction arrows 9. Combustion products enter the inner layer of coils 11 of coil bank 14.

Outer coil layer connections 16 permit fluid flow through pump 20 into manifold 17 into individual coils of the bank 11. Fluid flow exiting the coils 11 of the coil bank 12 exit the outer layer 13 of coil bank 12 at embedded coil outlets 18 and manifold 19.

In operation, the heater assembly 2 generates combustion products and gases by burning fuels in a burner 8 with combustion products entering a combustion chamber 6 and gases 9 exiting through combustion chamber choke 10. The exiting gases enter the heat exchanger or coil bank 12 through a chamber 33 generated by the coil inner layer 32 of coil assembly 30 (reference FIG. 3D). As the coil bank 12 as shown in FIG. 7, is part of a three-bank coil section 14, each having a similar function, the following descriptions of coil structure and operation will include a single coil of the multi-coil bank 12.

Figure 3A:
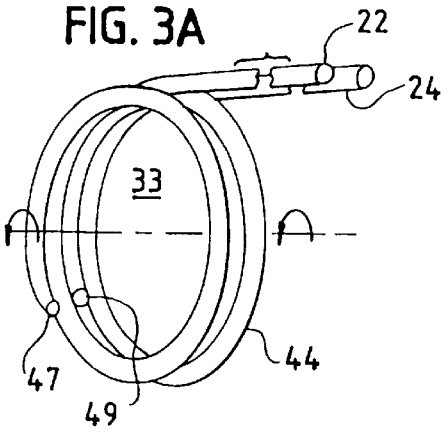
FIG. 3A is a tubing only pictorial representation of the bifilar winding technique, particularly showing a first layer wound from two individual tubing lengths.
Figure 3B:
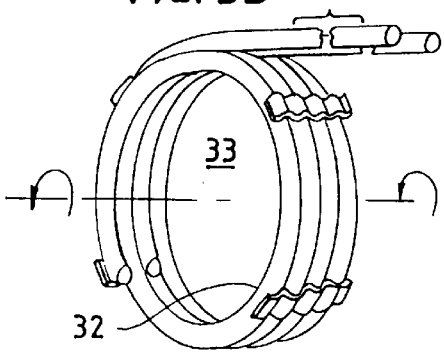
FIG. 3B is an additional tubing only drawing, particularly showing a full first layer wound from two individual tubing lengths having crossed over to a second layer.
Figure 3C:
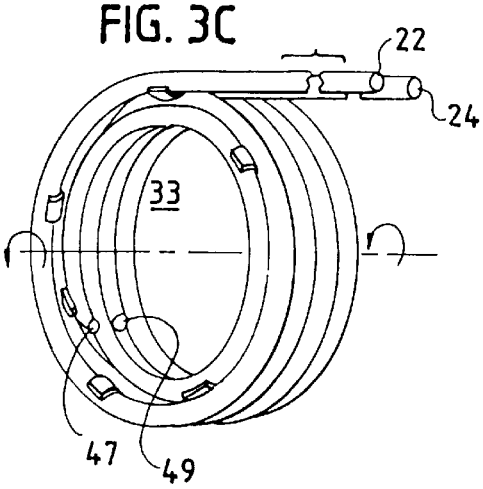
FIG. 3C is similar to FIG. 3B, particularly showing the winding of a third layer from individual tubing lengths.
Figure 3D:
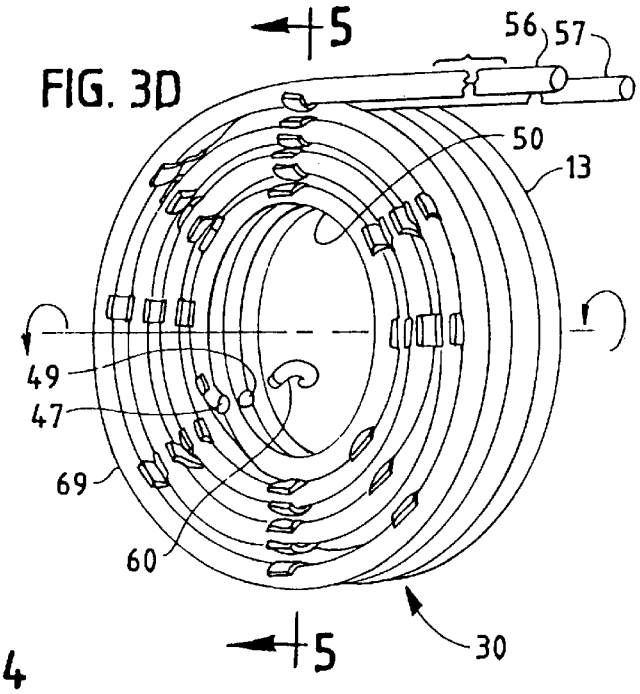
FIG. 3D is similar to FIG. 3C except that a final our outer tubing layer has been completed.

The gases 9 entering the heat exchanger coil section 12 having a chamber 33 (reference FIG. 3) created by inner layer 32, the gases flow radially through the coil bank or section 12 from said inner layer 32 through the outer layer 13 (reference FIG. 3D). Fluid flowing as discussed above in the parallel connected coil section 12 extracts heat from the combustion gases transferring said heat to the flowing fluid.

Construction of the coil of the invention is best understood by reference to FIG. 2 where there is shown coil winding device or assembly 40 having a rotating or driven mandrel 42 arranged to wind or bend tubing in multi-turn, multi-layer coils, such as disclosed in this invention. As shown in FIG. 2, turns of an initial or first tubing length have formed a portion of first layer 46 and turns of a second tubing length have formed a portion of a first layer 48. The winding process is as shown in U.S. Pat. No. 2,771,934.

With reference to FIG. 2A, the cross-overs from the first tubing length first layer 50 and cross-over 52 from the first tubing layer of the second tubing length are shown.

Turning now to FIGS. 3A through 3D and FIGS. 5 and 6, winding proceeds as described above by winding first and second tubing lengths 22 and 24 into an initial first layer 32 through coil second layer 52, coil third layer 53, coil fourth layer 54, coil fifth layer 55, sixth layer 68, and seventh layer 69, as shown. Appropriate coil and layer spacers are used as shown. The seventh layer 69 defines an outer coil surface in which the coil first and second tubing lengths terminal or exit ends 56 and 57 are embedded.

Figure 4:
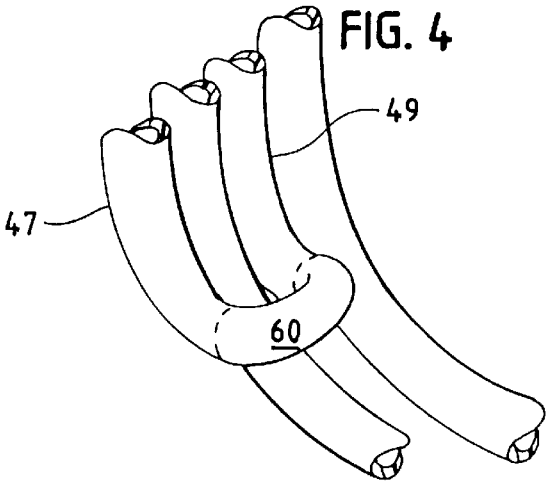
FIG. 4 is a partial perspective view of a first layer of the coil of the invention, particularly showing the connection between initial ends of the individual tubing lengths.

To complete the bifilar construction, a jumper 60 provides fluid communication between the initial end of the first tubing length 47 and the initial end of the second tubing length 49, as shown in FIG. 4.

A coil bank assembly consisting of three individual coils 30 arranged as shown at 12 in FIG. 7, inlet manifold 17 fluid communicates with individual coil inlets 56 of each coil at coil bank inlet 16 as shown. Similarly, fluid outlet manifold 19 communicates with exit ends of each individual coil 11 of coil assembly 14 by fluid communicating coil ends 57 at 18 and 56 at 16, as shown.

Figure 6:
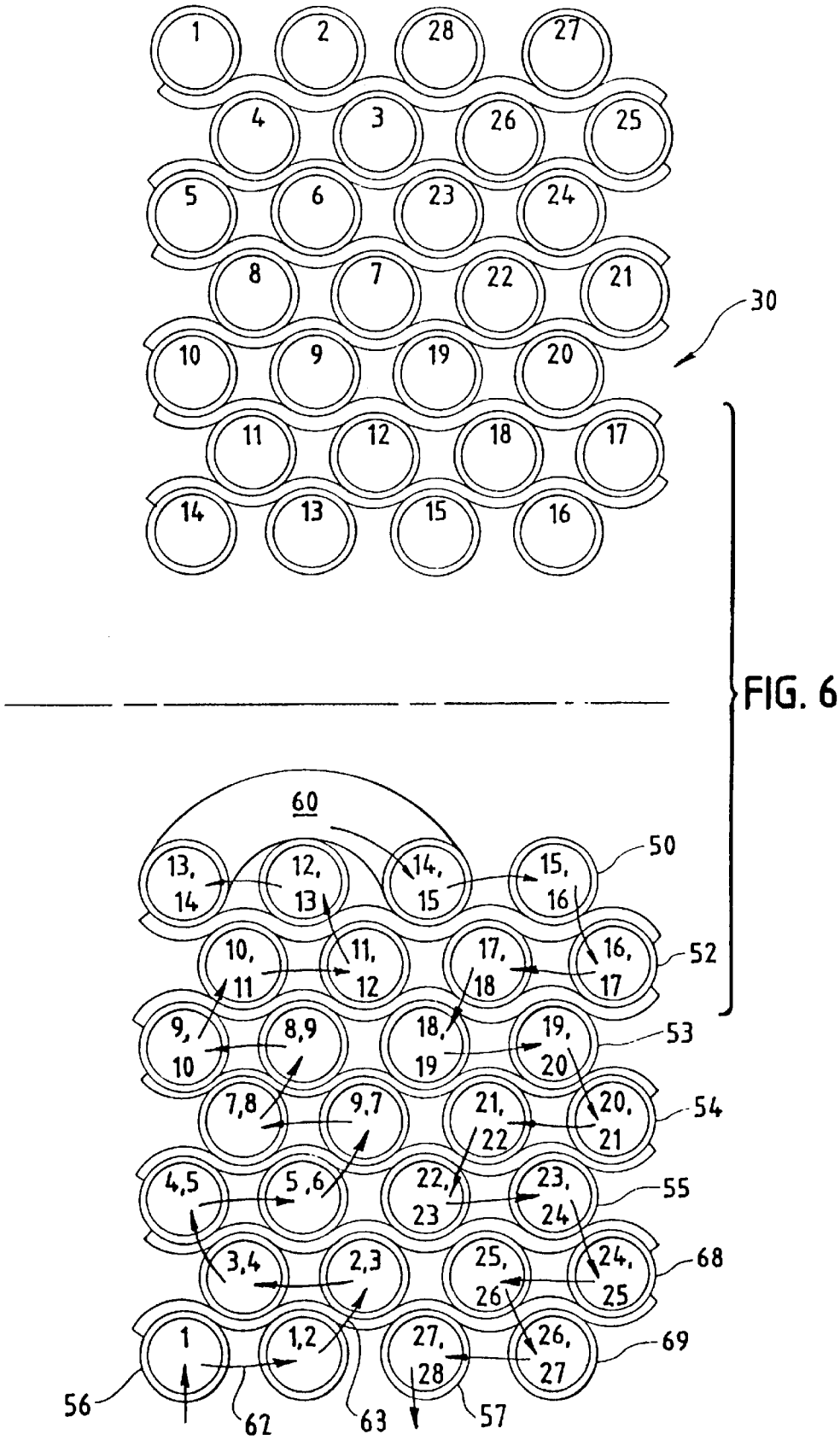
FIG. 6 is a figure similar to FIG. 5, however, showing the fluid flow patterns internal of the bifilar coil of the invention.
Figure 6A:
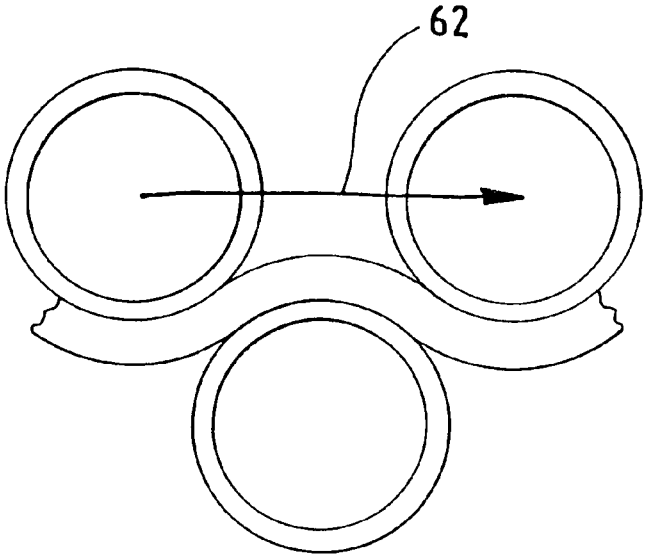
FIG. 6A is a partial coil section similar to FIGS. 5A and 5B, particularly showing fluid flow direction in individual tubing layers.
Figure 6B:
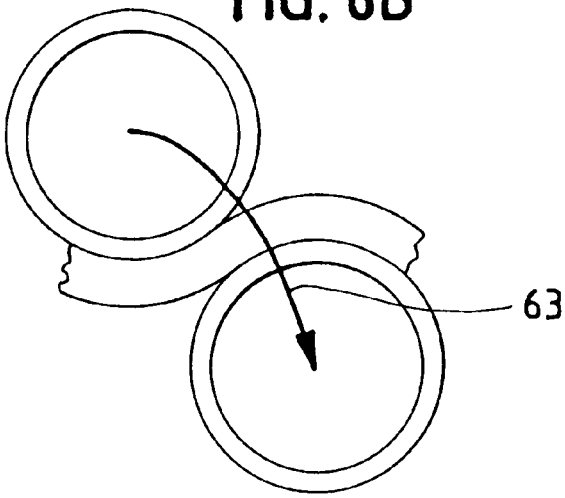
FIG. 6B is a partial coil section similar to FIG. 6A, particularly showing fluid flow from between coil layers.

Fluid flow internal of each individual bifilar coil is best shown by reference to FIG. 6 6A and 6B. Arrows 62, 63 show flow direction from turn to turn and layer to layer.

Using the above described convention, inlet flow in row 69, at 56 (cross-section+1) would exit at cross section 1 (°) and proceeds as shown by arrow 67 to next turn 2(+) and again exiting turn 2(°). Continuing flow crosses to layer 68 at cross section 1, 2 and arrow 68 as shown. Flow continues similarly from turn-to-turn, and layer-to-layer, exiting the coil portion formed from first tubing length 22, at 47, where passing through jumper 60, flow enters the second tubing length 24 at 14, 15 (+). Flow through second tubing length 24 proceeds, similarly exiting at 27, 28 (+) and outlet 57.

Figure 5:
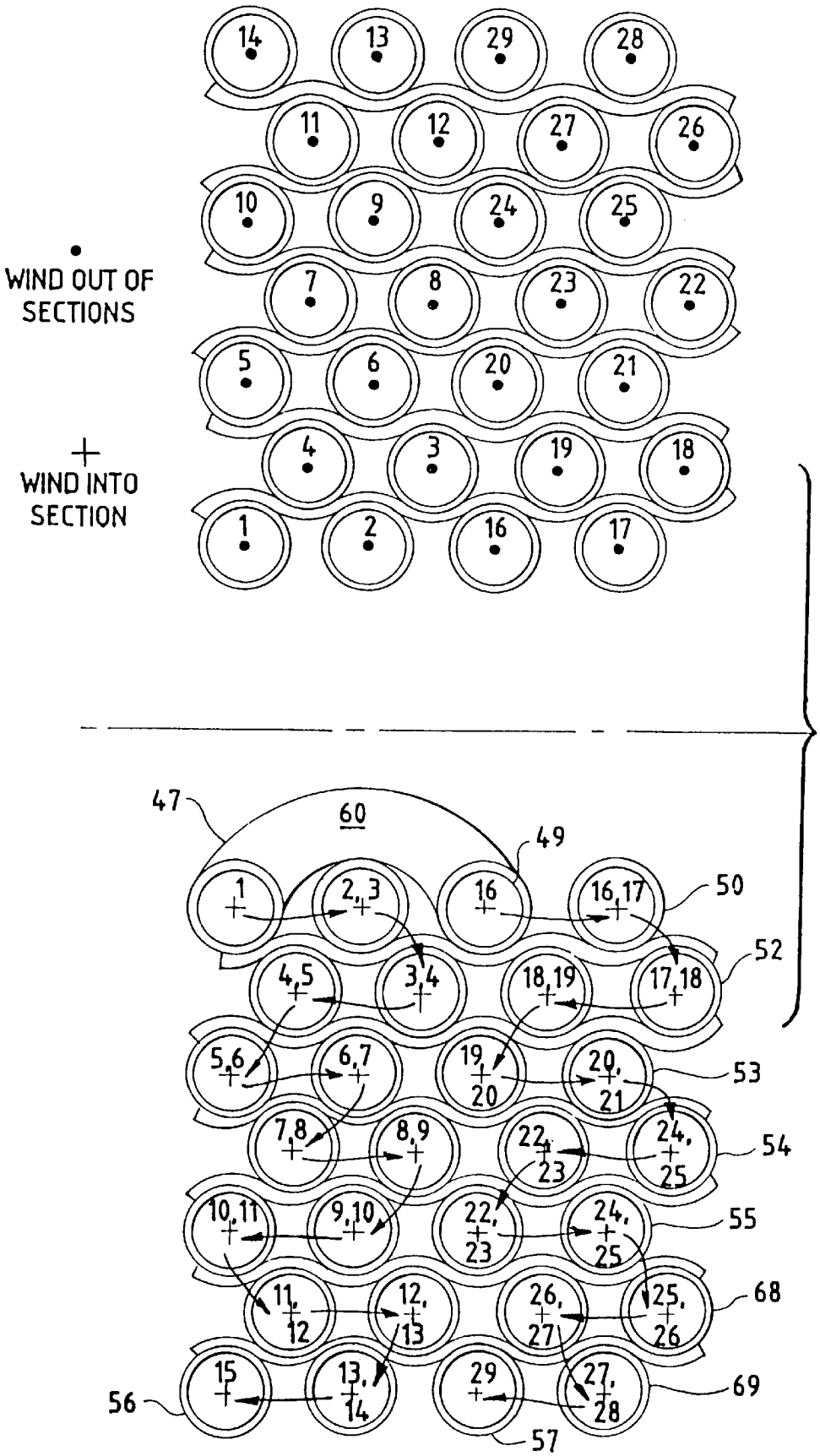
FIG. 5 is a sectional schematic of the coil of the invention along line 5—5 of FIG. 3D, particularly showing winding directions from the first internal layer to the final outer layer.

Similarly, winding is shown in FIG. 5 by arrow 64 (reference FIG. 5A) traversing tubing cross section in the same layer. Arrow 65 indicates winding cross-over from a given layer to an adjacent layer as shown.

Figure 5A:
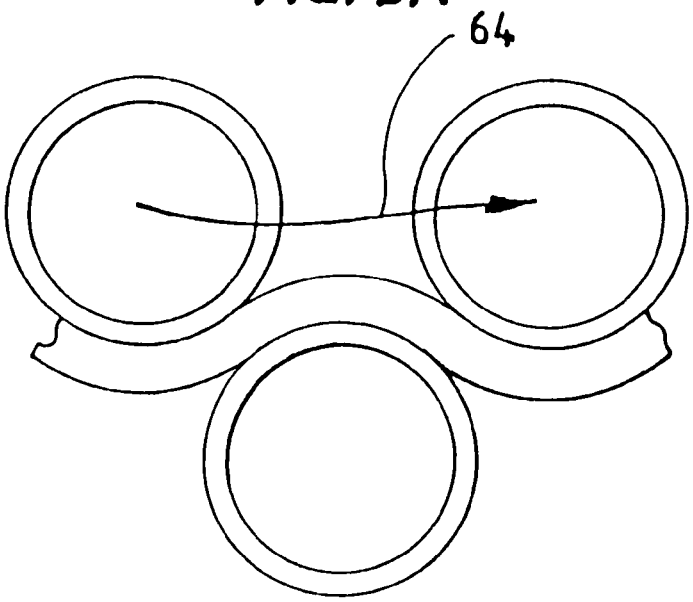
FIG. 5A is a partial coil section showing winding direction of tubing in coil manufacture, particularly showing winding in the same layer.
Figure 5B:
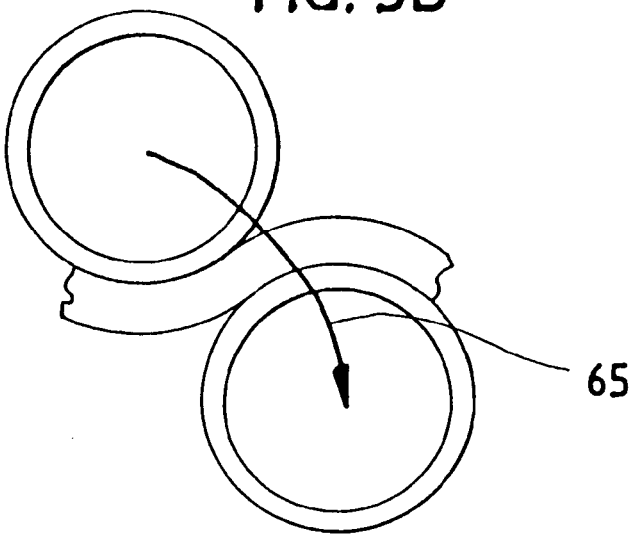
FIG. 5B is a partial coil section similar to FIG. 5A, particularly showing winding crossovers from layer to layer.

More specifically, with regard to FIG. 5 5A and 5B, the initial end of the first length is shown as 47 and the initial end of the second length is shown as 49. Winding proceeds as shown with first length proceeding from section 1 to section 2, 3 crossing over from tubing location 2, 3 to the second layer 52 at section 3, 4 winding in the second layer 52 to section 4.5 (+) then crosses to layer 53 at section 5, 6 (+), proceeding as shown until winding of the first and second lengths is complete with first length terminating at 56 and the second length terminating at 57.

As discussed above, the dotted numbers in the upper section of FIG. 5 show tubing having traversed from the lower section at station 3 and returning to layer 52 at section 3, 4. The winding pattern continues as shown as will be readily understood by those skilled in the art.

Thus, it is apparent that there has been provided in accordance with the invention disclosed herein a bifilar wound coil for a compact fluid heater that fully satisfies the objects, aims and advantages as set forth above. While the invention has been described in conjunction with a specific embodiment, it is evident that many alternatives, modifications and variations will be apparent to those skilled in the art in light of the foregoing description. Accordingly, the concepts and structure disclosed herein is intended to embrace all such alternatives, modifications, and variations as may fall within the spirit and broad scope of the appended claims.

Therefore, I, claim:

1. A method of winding a multiple turn, multiple layer heat exchange coil by forming first and second tubing lengths, said method including the steps of:

(a) locating and fastening a first end of each of said tubing lengths on a mandrel;

(b) bending each tubing length around said mandrel to form said coil having a predetermined number of turns and layers, said layers including an inner layer and an outer layer;

(c) crossing each said tubing length over a preceding coil layer end turn thereby positioning said tubing length to initiate a successive coil layer;

(d) spacing said turns and said layers to provide turn spacing and layer spacing to permit fluid flow around said turns and said layers; and (e) locating a second end of said first tubing length and a second end of said second tubing length at positions at least one of outside of said heat exchange coil and in said outer layer of said heat exchange coil.

2. A method, according to claim 1, wherein step (d) includes the step of positioning said turns in each subsequent layer outside of said inner layer generally at axial positions midway between axial positions of a pair of turns in a preceding layer.

3. A method, according to claim 1, wherein step (d) includes the step of introducing turn spacers to control said turn spacing of said coil.

4. A method, according to claim 3, wherein step (d) includes the step of positioning said turn spacers at predetermined circumferential positions of said coil between adjacent turns of said coil.

5. A method, according to claim 1, wherein step (d) further includes the step of introducing layer spacers to control said layer spacing of said coil.

6. A method, according to claim 1, wherein step (b) includes the step of rotating said mandrel.

7. A method, according to claim 1, wherein said method further comprises the step of joining said first end of said first tubing length and said first end of said second tubing length for fluid communication between said first tubing length and said second tubing length.

8. A method, according to claim 7, wherein said step of joining includes welding a jumper to said first end of said first tubing length and to said first end of said second tubing length.

9. A method, according to claim 8, wherein said step of joining is further characterized as welding a U-bend to said first end of said first tubing length and to said first end of said second tubing length.

10. A method, according to claim 1, wherein step (e) includes the step of forming a segment of said first tubing length adjacent said second end of said first tubing length so as to be tangential to said coil.

11. A method, according to claim 1, wherein step (e) includes the step of forming a segment of said second tubing length adjacent said second end of said second tubing length so as to be tangential to said coil.

12. A method of forming a fluid heater, said method comprising the steps of:

(a) forming a first heat exchanger coil by attaching a first end of a first tubing length and a first end of a second tubing length on a mandrel, bending said first tubing length and said second tubing length around said mandrel to form a multi turn, multi layer coil, locating a second end of said first tubing length and a second end of said second tubing length at positions at least one of outside of said first heat exchanger coil and in an outer layer of said first heat exchanger coil;

(b) joining said first end of said first tubing length to said first end of said second tubing length for fluid communication therebetween;

(c) forming at least one additional heat exchanger coil by repeating steps (a) and (b);

(d) forming a bank of heat exchanger coils;

(e) connecting a second end of each first tubing length for each of said bank of said heat exchanger coils to an inlet manifold;

(f) connecting a second end of each second tubing length for each of said heat of said heat exchanger coils to an outlet manifold; and (g) placing said bank of heat exchanger coils in a heater housing assembly to be heated therein by combustion products so that fluid entering said inlet manifold is heated in said heat exchanger coils and may be withdrawn from said outlet manifold.

* * * * *